US010961744B2

(12) United States Patent
Brennan

(10) Patent No.: US 10,961,744 B2
(45) Date of Patent: Mar. 30, 2021

(54) DOOR LATCHING SYSTEM HAVING A REDUCED PROFILE EXIT DEVICE

(71) Applicant: Hanchett Entry Systems, Inc., Phoenix, AZ (US)

(72) Inventor: John Brennan, Phoenix, AZ (US)

(73) Assignee: Hanchett Entry Systems, Inc., Phoenix, AZ (US)

( * ) Notice: Subject to any disclaimer, the term of this patent is extended or adjusted under 35 U.S.C. 154(b) by 0 days.

(21) Appl. No.: 17/029,592

(22) Filed: Sep. 23, 2020

(65) Prior Publication Data

US 2021/0002920 A1 Jan. 7, 2021

Related U.S. Application Data

(63) Continuation of application No. 16/006,991, filed on Jun. 13, 2018, now Pat. No. 10,794,084.

(60) Provisional application No. 62/520,158, filed on Jun. 15, 2017.

(51) Int. Cl.

| | |
|---|---|
| ***E05C 17/00*** | (2006.01) |
| ***E05B 17/00*** | (2006.01) |
| ***E05B 65/10*** | (2006.01) |
| ***E06B 5/10*** | (2006.01) |
| *E06B 3/70* | (2006.01) |

(52) U.S. Cl.

CPC ..... *E05B 17/0075* (2013.01); *E05B 65/1006* (2013.01); *E05B 65/1053* (2013.01); *E06B 5/10* (2013.01); *E06B 2003/7046* (2013.01)

(58) Field of Classification Search

CPC .... E05B 17/0075; E05B 65/1006; E05B 5/10; E05B 2003/7046; E05B 65/1053; Y10T 292/0908; Y10T 292/0909; Y10T 292/091; Y10T 292/0834; Y10T 292/0845; Y10T 292/0846; Y10T 292/62

USPC ..... 49/394, 395

See application file for complete search history.

(56) References Cited

U.S. PATENT DOCUMENTS

| | | | | |
|---|---|---|---|---|
| 5,526,660 | A | 6/1996 | Bennett et al. | |
| 6,490,895 | B1 | 12/2002 | Weinerman et al. | |
| 10,435,927 | B2 * | 10/2019 | Arlinghaus | E05B 63/0056 |
| 10,794,084 | B2 * | 10/2020 | Brennan | E05B 65/1053 |
| 2001/0019212 | A1 | 9/2001 | Fujiwara | |
| 2005/0144822 | A1 * | 7/2005 | Molokotos | G09F 13/22 40/570 |
| 2005/0146143 | A1 | 7/2005 | Lutfallah | |
| 2006/0232080 | A1 | 10/2006 | Washington et al. | |
| 2008/0143121 | A1 | 6/2008 | Blasen | |
| 2009/0019779 | A1 | 1/2009 | Nakanishi et al. | |
| 2009/0266120 | A1 * | 10/2009 | Tien | E05B 65/1053 70/107 |
| 2011/0219695 | A1 | 9/2011 | Ivasiv et al. | |
| 2012/0031010 | A1 | 2/2012 | Laconte | |
| 2013/0133384 | A1 | 5/2013 | Pickar | |

(Continued)

FOREIGN PATENT DOCUMENTS

WO 2007/017829 2/2007

*Primary Examiner* — Jerry E Redman

(74) *Attorney, Agent, or Firm* — Woods Oviatt Gilman LLP; Ronald J. Kisicki, Esq.; Dennis B. Danella, Esq.

(57) ABSTRACT

An exit device has an overall height when a panic bar of the exit device is in its extended position. The exit device is configured to be received, at least in part, within a recess defined within a body of the door so that the height at which the extended panic bar protrudes beyond an outer surface of the door is reduced.

3 Claims, 3 Drawing Sheets

(56) References Cited

U.S. PATENT DOCUMENTS

| | | | | |
|---|---|---|---|---|
| 2014/0059937 | A1* | 3/2014 | Harris | E05B 9/08 49/394 |
| 2014/0109479 | A1 | 4/2014 | Morstatt et al. | |
| 2015/0137528 | A1 | 5/2015 | Geringer et al. | |
| 2015/0167365 | A1 | 6/2015 | Musser et al. | |
| 2015/0183308 | A1 | 7/2015 | Buley et al. | |
| 2016/0002963 | A1* | 1/2016 | Kondi | E05B 65/1006 292/5 |
| 2016/0052231 | A1 | 2/2016 | Iacobucci | |
| 2016/0069107 | A1 | 3/2016 | Uyeda et al. | |
| 2016/0153218 | A1* | 6/2016 | Kondi | E05C 9/185 292/142 |
| 2016/0208525 | A1* | 7/2016 | Arlinghaus | E05B 63/0056 |
| 2018/0119456 | A1 | 5/2018 | Blanchard et al. | |
| 2018/0363326 | A1 | 12/2018 | Brennan | |

* cited by examiner

DOOR LATCHING SYSTEM HAVING A REDUCED PROFILE EXIT DEVICE

RELATIONSHIP TO OTHER APPLICATIONS AND PATENTS

The present application is a continuation of U.S. patent application Ser. No. 16/006,991, filed Jun. 13, 2018, now U.S. Pat. No. 10,794,084, which claims the benefit of U.S. Provisional Patent Application No. 62/520,158, filed Jun. 15, 2017, which are hereby incorporated by referenced in their entirety.

TECHNICAL FIELD

The present invention relates to an exit device for latching a hinged door into a frame; more particularly, to a recessed door latch system configured to operate the door latch while presenting a narrower exposed latch (push bar) profile than current latch profiles.

BACKGROUND OF THE INVENTION

Existing exit devices include some type of locking element such as a latch mechanism, which may be, for example, a Pullman style latch mechanism, a latch mechanism having a latch in the shape of a starwheel, a surface vertical rod latch mechanism, a concealed vertical rod latch mechanism or a mortise style latch mechanism. The locking element within the latch mechanism (referred to generically herein as a "latch") is required to rotate or retract out of the way of the mating locking element to reach a state of being unlocked. The latch may be mounted in a door and the mating locking element (referred to herein generically as a "strike") may be mounted on a door frame, or vice versa, to equal effect. The locking element may be disposed adjacent a side edge of the door and/or a top or bottom edge of the door.

Exit devices may typically employ what is commonly referred to as a panic bar to enable actuation of the exit device so as to enable door opening. Panic bars allow users to open the door without necessarily requiring the use of their hands. Rather, the user's body or other object can be used to push against the panic bar until the latch is retracted from the strike. Alternatively or additionally, exits devices may also include provision of an electrically actuatable latch such that, upon initiation, an electric current is supplied to an actuator to withdraw the latch from the strike.

To preserve the structural integrity of a fire door, panic bars are typically mounted onto the interior and/or exterior face of the fire. As a result, a high profile of the panic bar extends outwardly from the door and into the space immediately before the door. In certain instances, such as when used in a hospital or other medical setting, the outwardly extending panic bar may present hazards to medical personnel or patients. For instance, the panic bar may present an object which may by struck by medical patients, such as those confined to a wheel chair or hospital bed, or may otherwise interfere with clearances of these and other hospital conveyances, such as gurneys, equipment carts and portable laboratory equipment.

Therefore, in a fire door application, what is needed in the art is a panic bar and associated latch mechanism, wherein the panic bar, without compromising the integrity of the fire door, presents a smaller profile beyond the surface of the door while also providing sufficient travel of the panic bar to effect actuation of the latch mechanism and withdrawal of the latch from the strike.

It is a principal object of the present invention to address these, as well as other, needs.

SUMMARY OF THE INVENTION

Briefly described, an exit device having a panic bar may be configured for use in conjunction with a door latch system. The door latch system releasably secures a door in a door frame wherein the door latch system is selectively moveable from a latched position whereby the door is secured in the door frame, to an unlatched position whereby the door is releasable from the door frame. The exit device is configured to reside at least in part within a recess or mortise defined within a body of the door.

In one aspect of the present invention, the height of the panic bar extending beyond the outer surface of the door when said panic bar is in said extended position is reduced.

Numerous applications, some of which are exemplarily described below, may be implemented using the present invention.

BRIEF DESCRIPTION OF THE DRAWINGS

The present invention will now be described, by way of example, with reference to the accompanying drawings, in which.

Figure 1:
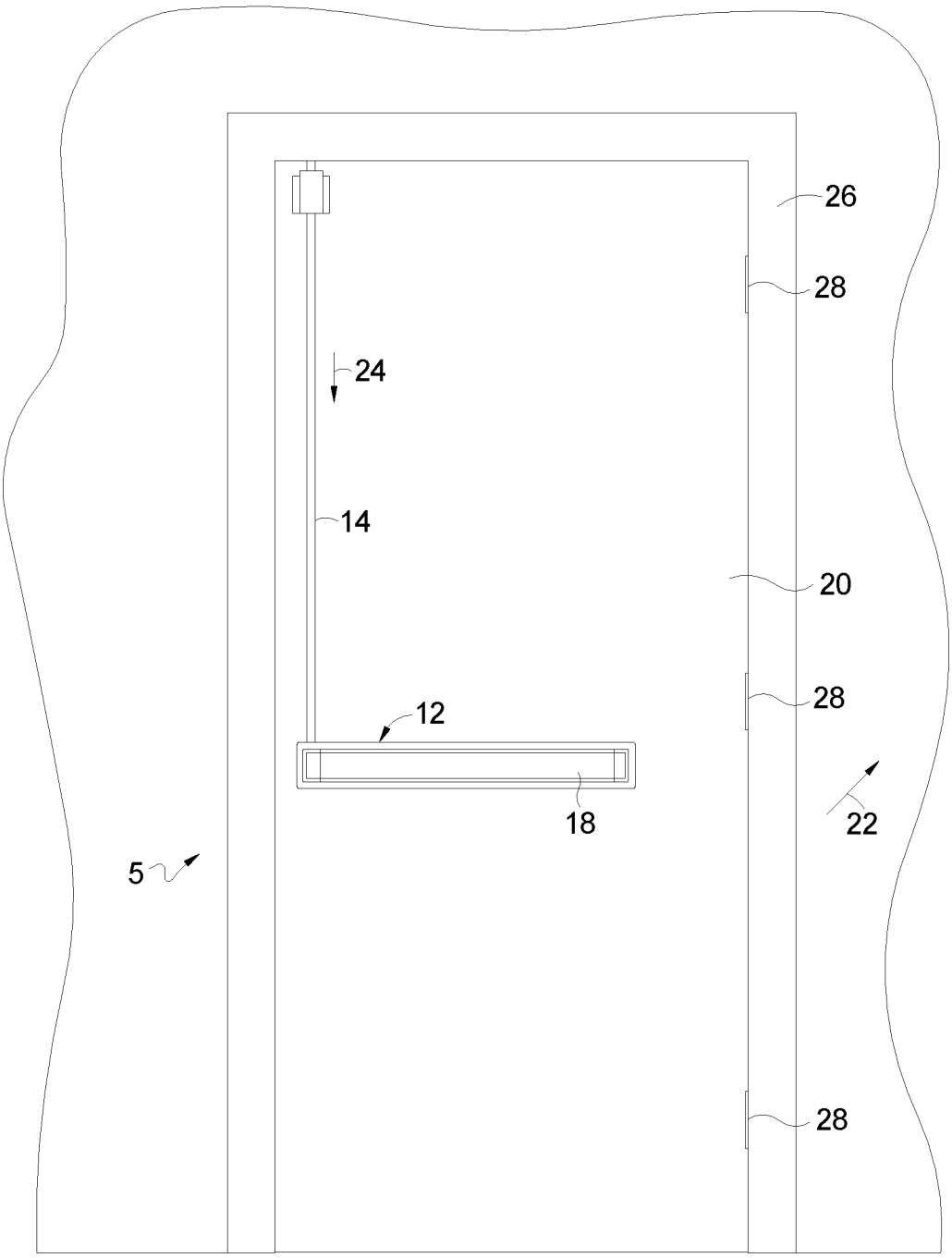
FIG. 1 is a front plan view of a door and exit device in accordance with an aspect of the present invention.

Corresponding reference characters indicate corresponding parts throughout the several views. The exemplifications set out herein illustrate currently preferred embodiments of the present invention, and such exemplifications are not to be construed as limiting the scope of the invention in any manner.

DESCRIPTION OF THE PREFERRED EMBODIMENTS

Figure 2:
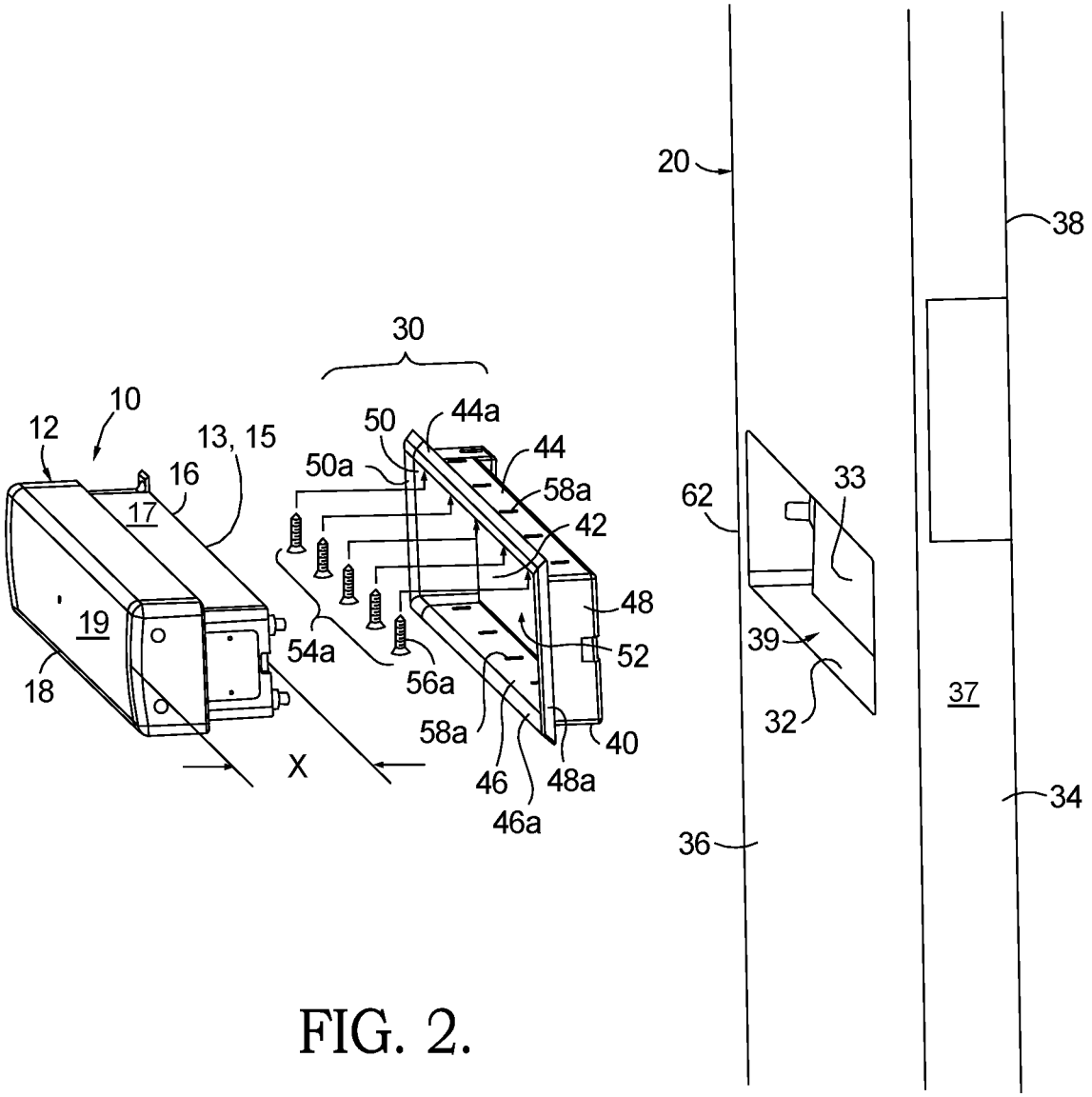
FIG. 2 is an exploded perspective view of the door and exit device shown in FIG. 1.

Referring to FIG. 1, door latching system 5, including door 20 and exit device 10, is shown. Exit device 10 may generally include latch mechanism 12 having a latch 14 that may be configured to be actuated through an actuating mechanism 16, such as for example, a panic bar style actuating mechanism (see FIGS. 2 and 4), which may include a panic bar 18 mounted on door 20. Actuating mechanism 16 resides at least in part in base 17 of latch mechanism 12 wherein base 17 includes bottom wall 15 opposite actuating surface 19 toward bottom wall 15 of base 17 of panic bar 18. Depression of panic bar 18 upon actuating surface 19, such as in an actuating direction 22, i.e., generally into the page, operates to move latch 14 in an unlocking direction 24 which may be generally orthogonal to actuating direction 22. Such movement causes latch 14 to disengage from a corresponding strike (not shown) which is secured in door frame 26. In this manner, door 20 may be pivotally opened about hinges 28. When panic bar 18 is in its extended position as shown in FIG. 2, the overall height of exit device 10 measured between actuating surface 19 of panic bar 18 and bottom surface 13 of bottom wall 15 is shown as X. While latch mechanism 12 has been shown as a concealed vertical rod latch mechanism, it should be appreciated by those skilled in the art that any suitable latch mechanism may be employed, including but not limited solely thereto, a Pullman style latch mechanism, a mechanism having a starwheel-shaped latch, a surface vertical rod latch mechanism or a mortise style latch mechanism.

Door 20 includes a first face 36, a second face 38 opposite first face 36, an edge surface 37 joining faces 36 and 38 at a right angle, and a recess 32 defined within body 34 of door 20 for receiving exit device 10 (FIG. 2). Recess 32 includes recessed surface 33, generally parallel with first and second faces 36, 38, and disposed between first face 36 and second face 38 of door 20 to form a well 39 for receiving exit device 10. It should also be noted that door 20 has been shown in phantom in FIG. 1 so as to enable viewing of various internal components of an exemplary latch mechanism 12, such as latch 14.

As shown more clearly in FIGS. 2-4, door latching system 5 may further include a reinforcing assembly 30 configured to receive latch mechanism 12 within latch receiving cavity of reinforcing assembly 30 so that bottom surface 13 of bottom wall 15 resides below first face 36 of door 20 and between the first face 36 and second face 38 of the door. In this manner, since at least a portion of exit device 10 is received within well 39, the profile of exit device 10 (i.e., the height at which actuating surface 19 of panic bar 18 extends beyond surface 36 of door 20 when the panic bar 18 is in its extended position) is reduced.

Door 20 may be a solid core door, such as but not limited to a solid wood door or a door having a non-wood core, such as a fiberglass core with wood veneer. In one aspect of the present invention, a door 20 may be employed as a fire door which meets or exceeds applicable fire-code regulations. In a further aspect of the present invention, door 20 may be a hollow core door configured to include internal structural supports selectively positioned within body 34 so as to define recess 32 therein.

As shown in FIG. 2, recess 32 is configured to receive at least a portion of base 17 of latch mechanism 12. Recess 32 may be a stub mortise cut into first face 36 of door 20 without passing completely through opposing second face 38 of door 20. It should be noted that second face 38 may include a bore extending therethrough for passage of a latch actuation shaft (not shown) configured to couple with latch mechanism 12 and latch 14 thereby permitting actuation of the latch from either side of door 20. As shown in FIG. 3, exemplary latch mechanism 12 may include a concealed vertical rod (CVR) latch 14*a* such that recess 32 may be a generally closed mortise configured to receive reinforcing assembly 30. Reinforcing assembly 30 may comprise body 40 including a back plate 42, opposing top wall 44 and bottom wall 46, and opposing left side wall 48 and right side wall 50, thereby defining an exit device receiving cavity 52 configured to receive at least a portion of base 17 of actuating mechanism. In accordance with an aspect of the present invention, body 40 may be fabricated from a metal, such as aluminum or steel, or from some other rigid, nonflammable material. Back plate 42 and/or walls 44, 46, 48 and 50 may be formed separately and then joined together as a unit, or formed as a unit. As a result, reinforcing assembly 30 may structurally reinforce door 20 at recess 32 so that door 20 may, for instance, meet or exceed applicable fire code regulations for fire doors. By way of example, reinforcing assembly 30 may prevent fire penetration through the door for a period of time as specified by the door's fire rating (i.e., 30, 60 or 90 minutes) following exposure to flames, as well as withstand the force of a water blast from a fire hose for more than a code-prescribed number of seconds.

Figure 3:
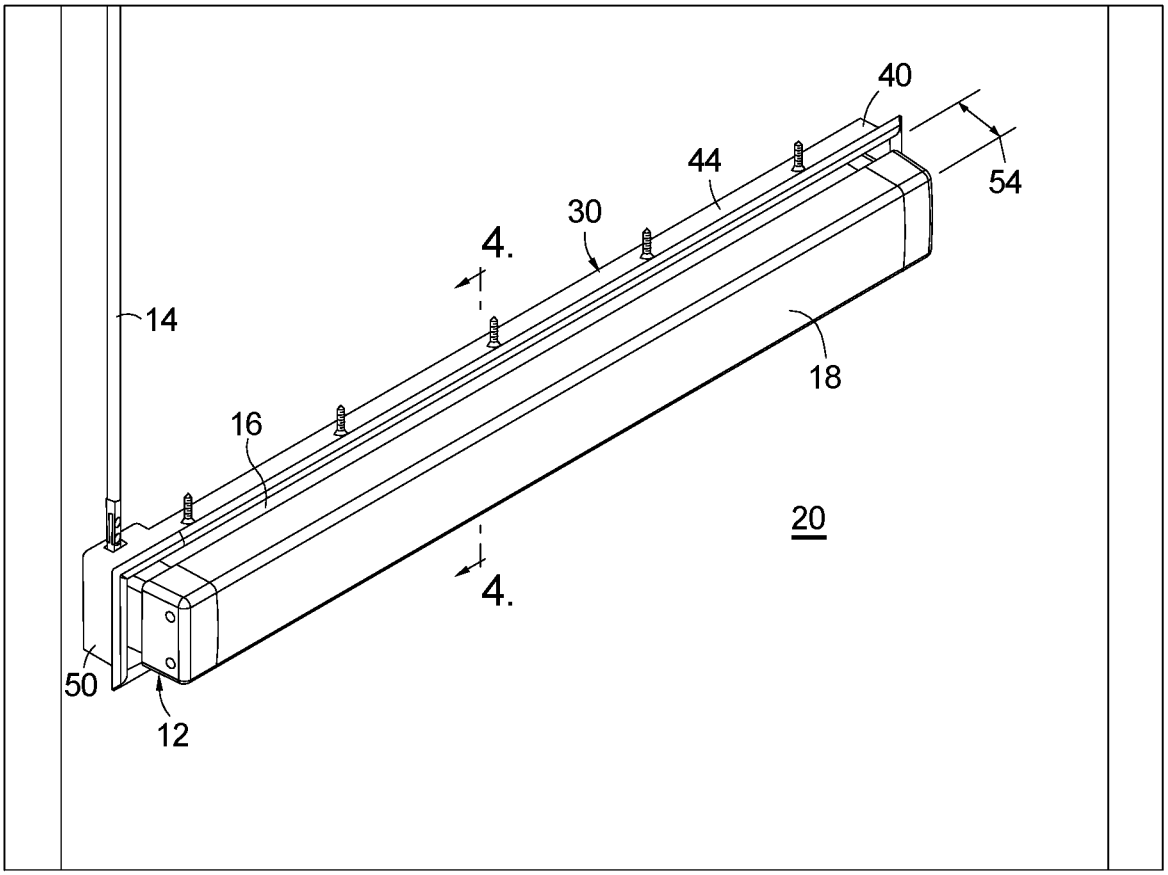
FIG. 3 is an expanded perspective view of the door and exit device shown in FIG. 1.
Figure 4:
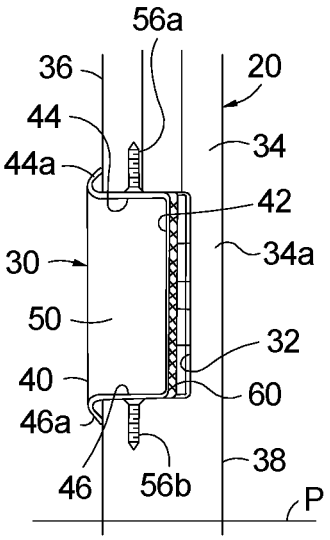
FIG. 4 is a cross section view of a portion of the door latching system taken generally along line 4-4 as shown in FIG. 3.

With continued reference to FIGS. 2-4, reinforcing assembly 30 may be secured within recess 32 through one or more fasteners 56*a*, such as but not limited to screws, received within and passing through corresponding holes 58*a* defined within at least one of top wall 44, bottom wall 46, side wall 48 or side wall 50 whereby each fastener 56*a* engages body 34 of door 20. (Fasteners 56*a* are shown passing through corresponding holes 58*a* in top wall 44). In accordance with an aspect of the present invention, fasteners 56*a*, may be oriented substantially normal to transverse plane P of door 20, e.g., about 90° with respect to plane P (FIG. 4). In this manner, the integrity of door 20 is not compromised by avoiding securing fasteners 56*a* within the thinned door webbing of body portion 34*a* created when forming recess 32. That is, fasteners 56*a* are received within the full structure of door 20 adjacent recess 32. Additionally, longer fasteners may be used without the threat of puncturing or extending outwardly through second face 38 of door 20, thereby further promoting door integrity.

Moreover, securing fasteners within the thinner webbing of body portion 34*a* may also lead to premature door failure upon repeated use, such as through formation of cracks which may result from the reduced door thickness of the webbing repeatedly experiencing the forces applied to panic bar 18 by users or through action of latch mechanism 12. Consequently, the door's ability to act as a fire barrier may be compromised by the cracks as the forces applied to panic bar 18 are directed into the thinner door webbing via the fasteners. In contrast, by orienting fasteners 56*a* substantially normal to transverse plane P, forces applied to panic bar 18 are directed into body 34 through fasteners 56*a*, and not into the thinner webbing of body portion 34*a*.

The open terminal ends (opposite back plate 42) of top wall 44, bottom wall 46, left side wall 48 and right side wall 50 may include a respective outwardly extending lip portion 44*a*, 46*a*, 48*a*, 50*a*. Each lip portion 44*a*, 46*a*, 48*a*, 50*a* may be formed so as to abut against first face 36 of door 20 when reinforcing assembly 40 is secured within recess 32 as described above. In this manner, lip portions 44*a*, 46*a*, 48*a*, 50*a* may conceal the cut edge of door 20 forming recess 32. Moreover, in the event that door 20 is to operate as a fire door in accordance with applicable building fire codes, lip portions 44*a*, 46*a*, 48*a*, 50*a* may also slow or even prevent ingress of flames into recess 32, thereby extending the fire barrier lifetime of door 20. Fire retardant insulation material 60 may also be used to fill any gaps along the bottom or walls of body 30 between recess 32 and reinforcing assembly 40, thereby further improving the fire rating of door 20.

Lip portions 44*a*, 46*a*, 48*a* and 50*a* may also serve to provide support for reinforcing assembly 30 via face 36 of door 20, thereby minimizing or eliminating the force exerted against the thinner webbing of body portion 34*a* when an opening force is applied to panic bar 18.

While shown and described as a closed mortise, it should be understood by those skilled in the art that recess 32 may be an open mortise whereby one or both ends of the mortise coincide with a side edge of door 20, such as side edge 62 (FIG. 2). A corresponding reinforcing assembly may be configured to be received within the open mortise and may be formed without one or both side walls 48, 50. In this manner, the cavity defined within the open mortise reinforcing assembly may also be positioned coterminous with side edge 62 of door 20.

Note that, in accordance with the invention, the reinforcing assembly may be configured to receive any type of latch mechanism that may be mounted in a mortise recess formed in the face of a door.

While the invention has been described by reference to various specific embodiments, it should be understood that numerous changes may be made within the spirit and scope of the inventive concepts described. Accordingly, it is intended that the invention not be limited to the described embodiments, but will have full scope defined by the language of the following claims.

What is claimed is:

1. A door latching system comprising:

a) a door having a first face, a second face opposite said first surface, an edge surface joining said first face and said second face, and a recess formed in said first face without passing through said second face, wherein said recess includes a recessed surface disposed between said first face and second face; and b) an exit device including:

an exit device base receivable by said recess, wherein said exit device base includes a bottom surface, and a panic bar received by said exit device base, wherein said panic bar is moveable relative to said exit device base between an extended position and a depressed position, wherein said panic bar includes an actuating surface opposite said bottom surface of said exit device base, and wherein said actuating surface is at an extended height relative to said bottom surface of said exit device base when said panic bar is in said extended position, wherein said exit device base is received by said recess of said door so that said bottom surface of said exit device base faces said recessed surface of said recess, and wherein when said exit device base is received by said recess of said door, said bottom surface resides between said first and second faces of said door, and said actuating surface of said panic bar extends beyond said first face of said door when said panic bar is in said extended position so that said first face of said door is between said actuating surface of said panic bar and said second face of said door whereby said extended height of said actuating surface is reduced.

2. The door latching system according to claim 1 further includes a reinforcing assembly, wherein a bottom wall of said reinforcing assembly resides between said bottom surface of said base of said exit device and said recessed surface of said recess when said exit device is received by said recess of said door.

3. The door latching system according to claim 1 wherein an entire length of said exit device base is received in said recess.

* * * * *